United States Patent [19]

Gallimore et al.

[11] Patent Number: 4,592,263

[45] Date of Patent: Jun. 3, 1986

[54] ELECTRO-MECHANICAL STRINGED BASS MACHINE

[76] Inventors: Byron A. Gallimore, Rte. 2, Puryear, Tenn. 38251; Charles R. Stone, Rte. 1, Benton, Ky. 42025

[21] Appl. No.: 736,384

[22] Filed: May 21, 1985

[51] Int. Cl.[4] ..... G10D 1/00; G10C 3/20

[52] U.S. Cl. ..... 84/173; 84/246

[58] Field of Search ..... 84/12, 17, 19, 173, 84/170, 171, 258, 18, 20, 246, 242, 284

[56] References Cited

U.S. PATENT DOCUMENTS 72,824 12/1867 Durand ..... 84/284

356,109 1/1887 Ellis ..... 84/242

3,117,481 1/1964 Cushing ..... 84/19

4,156,380 5/1979 Fulton ..... 84/173 X

*Primary Examiner*—L. T. Hix

*Assistant Examiner*—Douglas S. Lee

*Attorney, Agent, or Firm*—B. P. Fishburne, Jr.

[57] ABSTRACT

A stringed bass machine is disclosed in which vertical bass guitar strings are struck by hammers and are not plucked or strummed. An electrically operated upright piano action receives power from an external control box having an on-off switch. A musician can operate the bass machine by means of a remote keyboard and/or pedalboard. A unique sound is derived from an acoustically insulated soundboard, which encloses the guitar strings and piano action.

10 Claims, 12 Drawing Figures

FIG.1
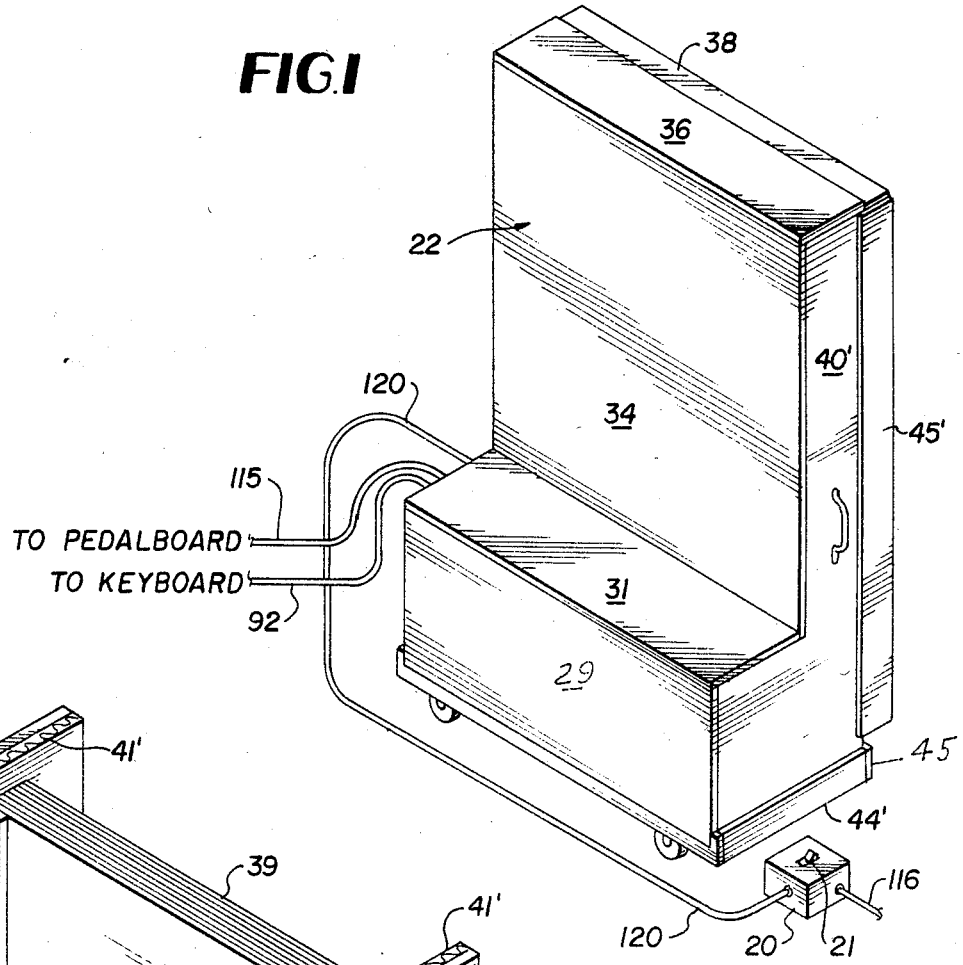
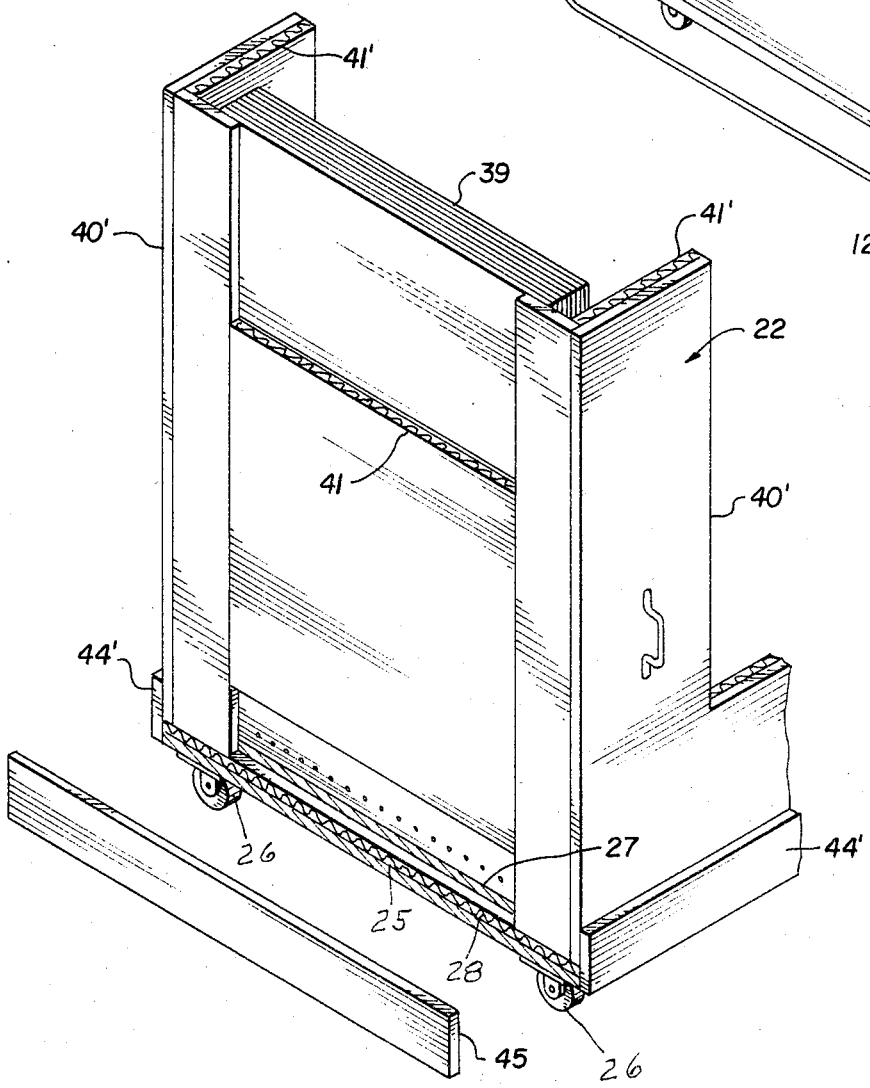
FIG.2

ELECTRO-MECHANICAL STRINGED BASS MACHINE

BACKGROUND OF THE INVENTION

U.S. Pat. No. 4,156,380 discloses an electrically operated guitar having a sound box within which guitar strings are fretted and strummed or plucked. By using a keyboard, a musician can create the sounds characteristic of the electric guitar.

The present invention has for its main objective to provide an electrically operated bass machine in which the bass strings are struck by hammer elements and are not plucked or strummed. Cooperative string dampering heads eliminate string fretting and a uniquely different musical sound is produced by the instrument as a result of striking the strings within an acoustically insulated enclosure or "soundboard". The sound produced by the machine is derived from a combination of acoustical dampering, reverberation and resonance not achievable in any known prior art device.

A further object of the invention is to provide an improved electro-mechanical bass machine of the above-noted type which a musician can operate by a remote keyboard and/or pedalboard, while simultaneously playing other instruments.

Another object of the invention is to provide a musical instrument of the above-noted type which is comparatively simplified in its construction, entirely practical, convenient to operate and constructed largely from commercially available components.

Other objects and advantages of the invention will become apparent during the course of the following detailed description.

BRIEF DESCRIPTION OF THE DRAWINGS

FIG. 1 is a front perspective view of an electromechanical bass machine according to the invention.

FIG. 2 is a rear perspective view of the machine, partly broken away and parts omitted.

DETAILED DESCRIPTION

Figure 10:
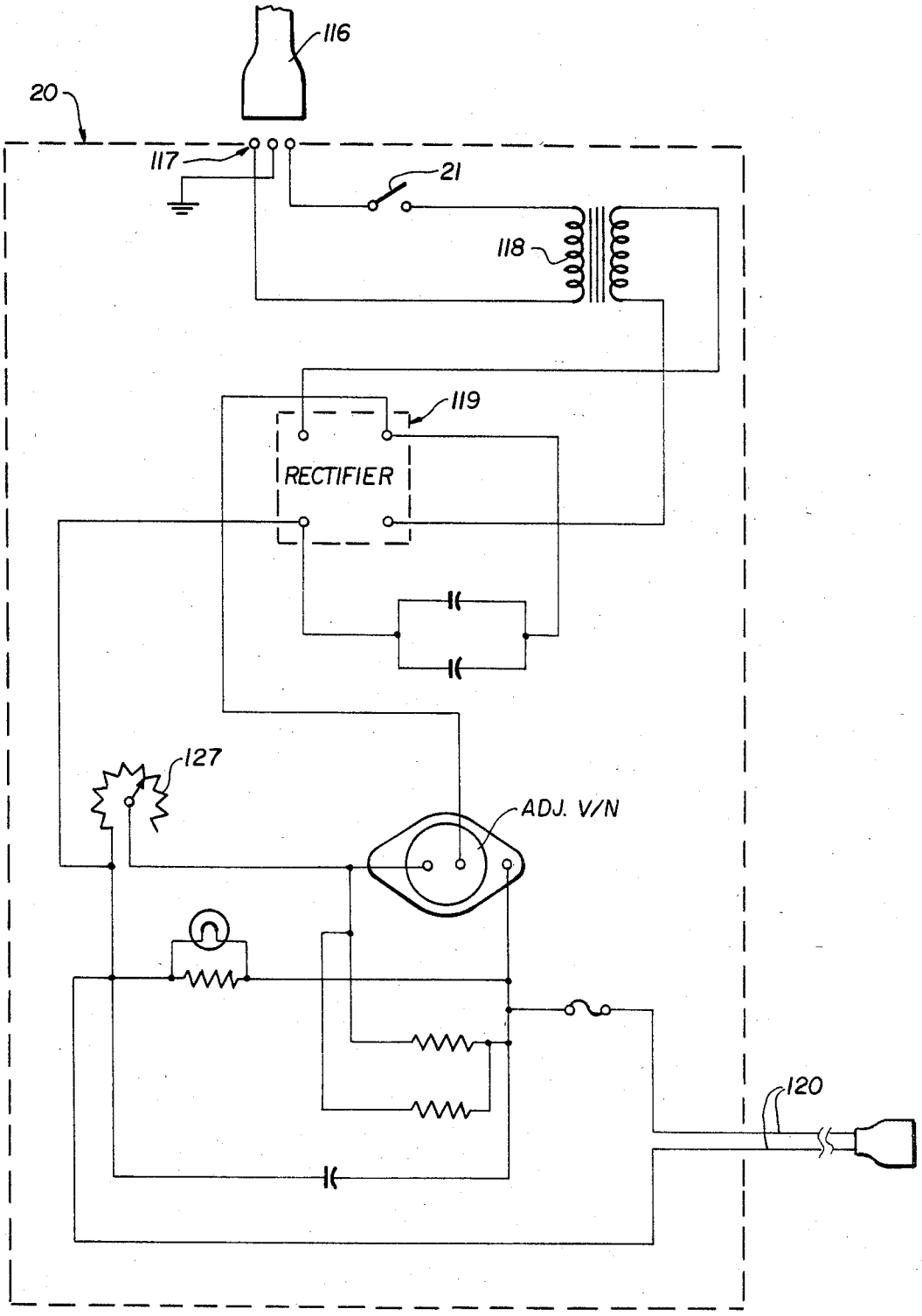
FIG. 10 is a schematic view of a power circuit.

Referring to the drawings in detail wherein like numerals designate like parts, an electro-mechanical string bass machine according to the present invention comprises four main components, namely, an external control box 20 having an on-off switch 21 mounted thereon, FIGS. 1 and 10; a sound producing enclosure or "soundboard" 22: a remote keyboard 23; and a remote pedalboard 24.

Figure 4:
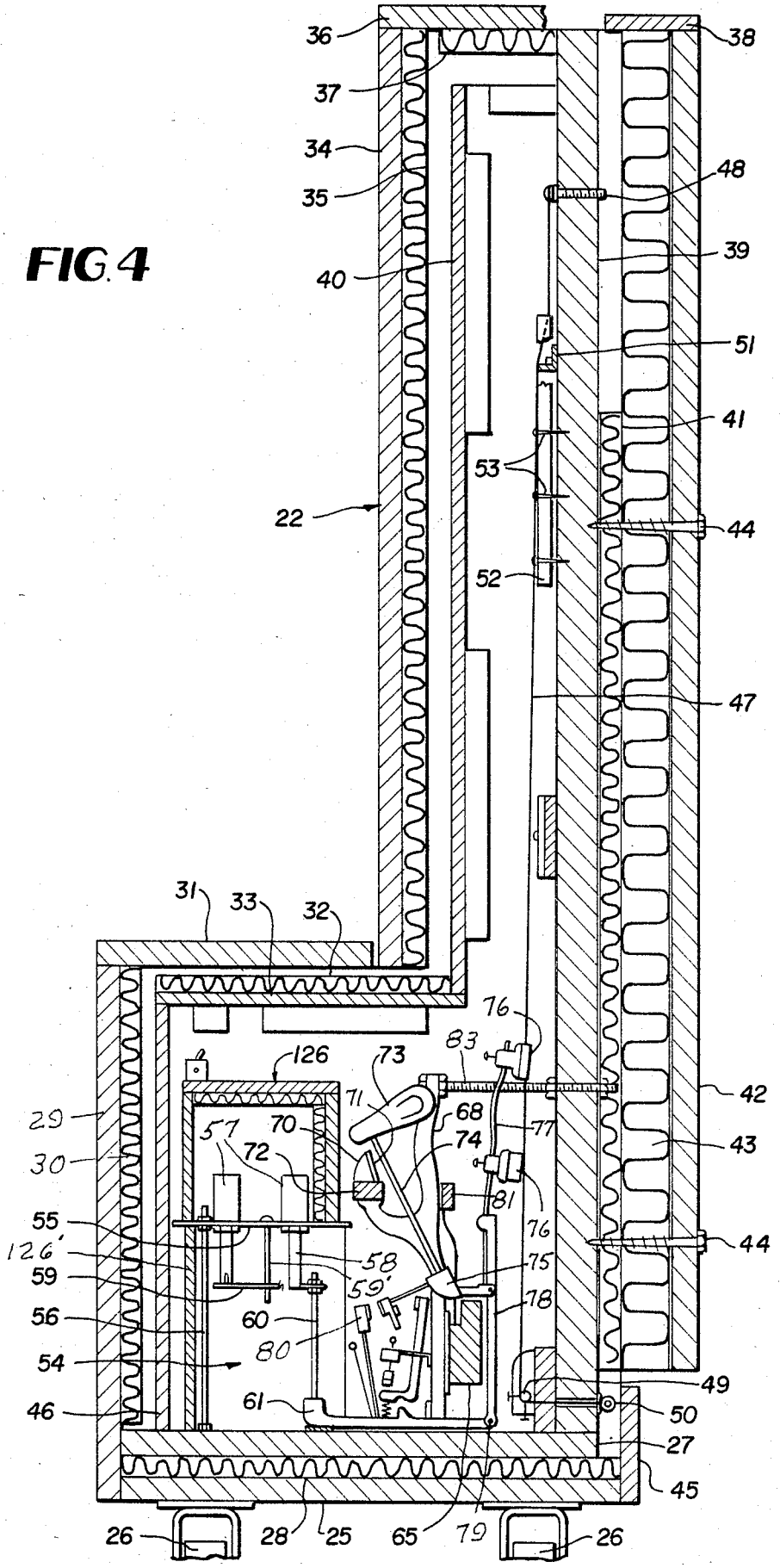
FIG. 4 is a vertical cross sectional view of the machine.

The soundboard 22, FIG. 4, comprises a bottom exterior panel 25 having four casters 26 mounted thereon near the corners thereof to render the machine readily movable from place-to-place. A bottom interior panel 27 is spaced somewhat above the panel 25 with a layer of acoustical insulation 28 disposed therebetween. A lower front vertical panel 29 rises from the two bottom panels 25 and 27 and is suitably fixed thereto. A layer 30 of acoustical insulation is fixed to the interior face of the panel 29. A lower horizontal panel 31 fixed to the top edge of the panel 29 extends rearwardly thereof and an underlying acoustical insulation layer 32 is disposed between the panel 31 and an interior cover 33 parallel to the panel 31. An upper vertical panel 34 rises from the panel 31 and carries on its interior face a layer of acoustical insulation 35. A top horizontal panel 36 has its bottom surface covered by a layer of acoustical insulation 37 and a top rear cover strip 38 completes the closing of the top of the soundboard 22.

A standard piano double pin block 39 is vertically disposed within the soundboard 22 and extends from top-to-bottom thereof, FIG. 4. A vertical front interior panel 40 is spaced forwardly of the double pin block 39 in parallel relation thereto. The front interior panel 40 extends from the rear edge of horizontal interior cover 33 upwardly to a point just below the insulation layer 37.

Figure 3:
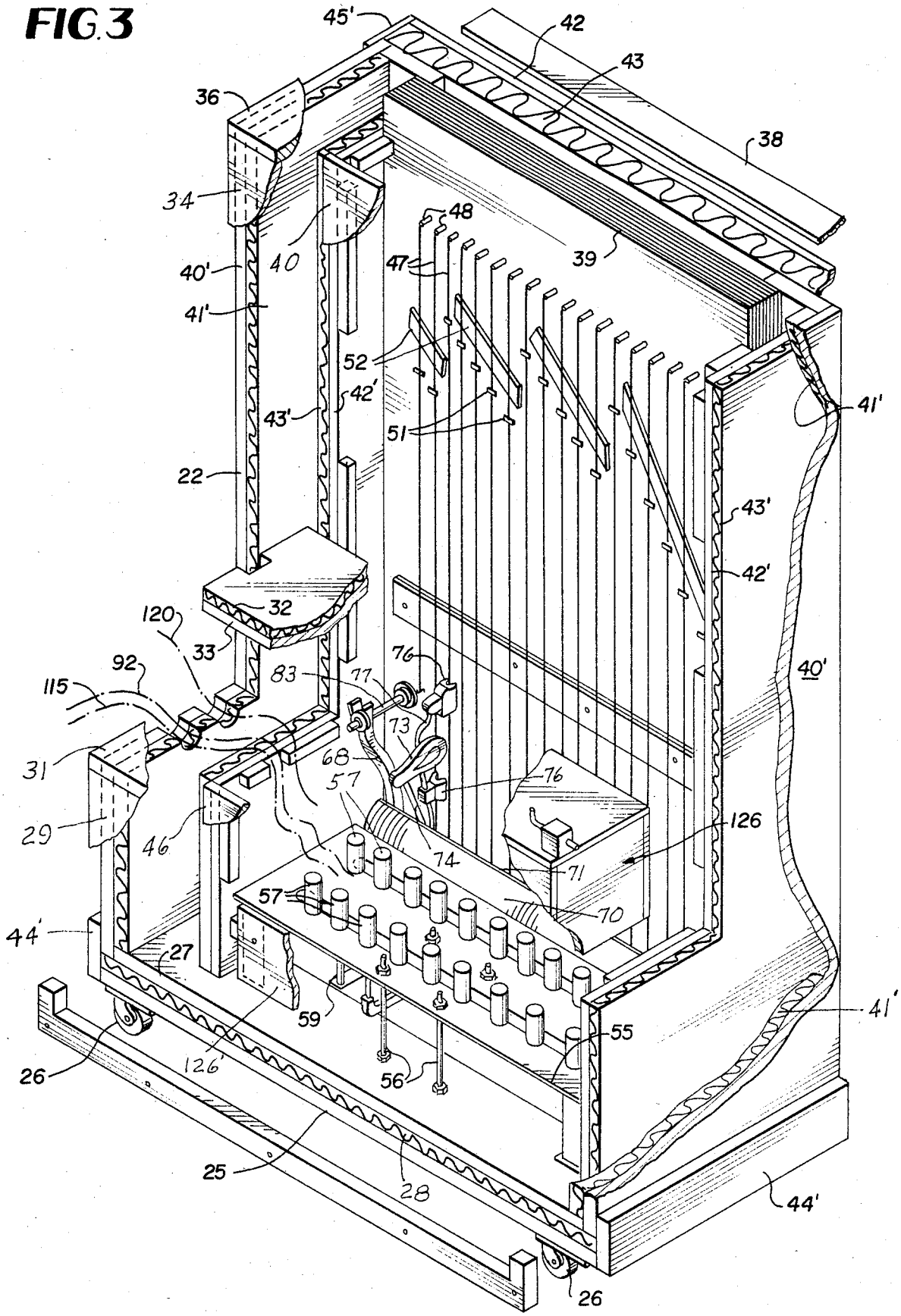
FIG. 3 is a front perspective view of the machine, partly in cross section and with parts exploded and broken away.
Figure 12:
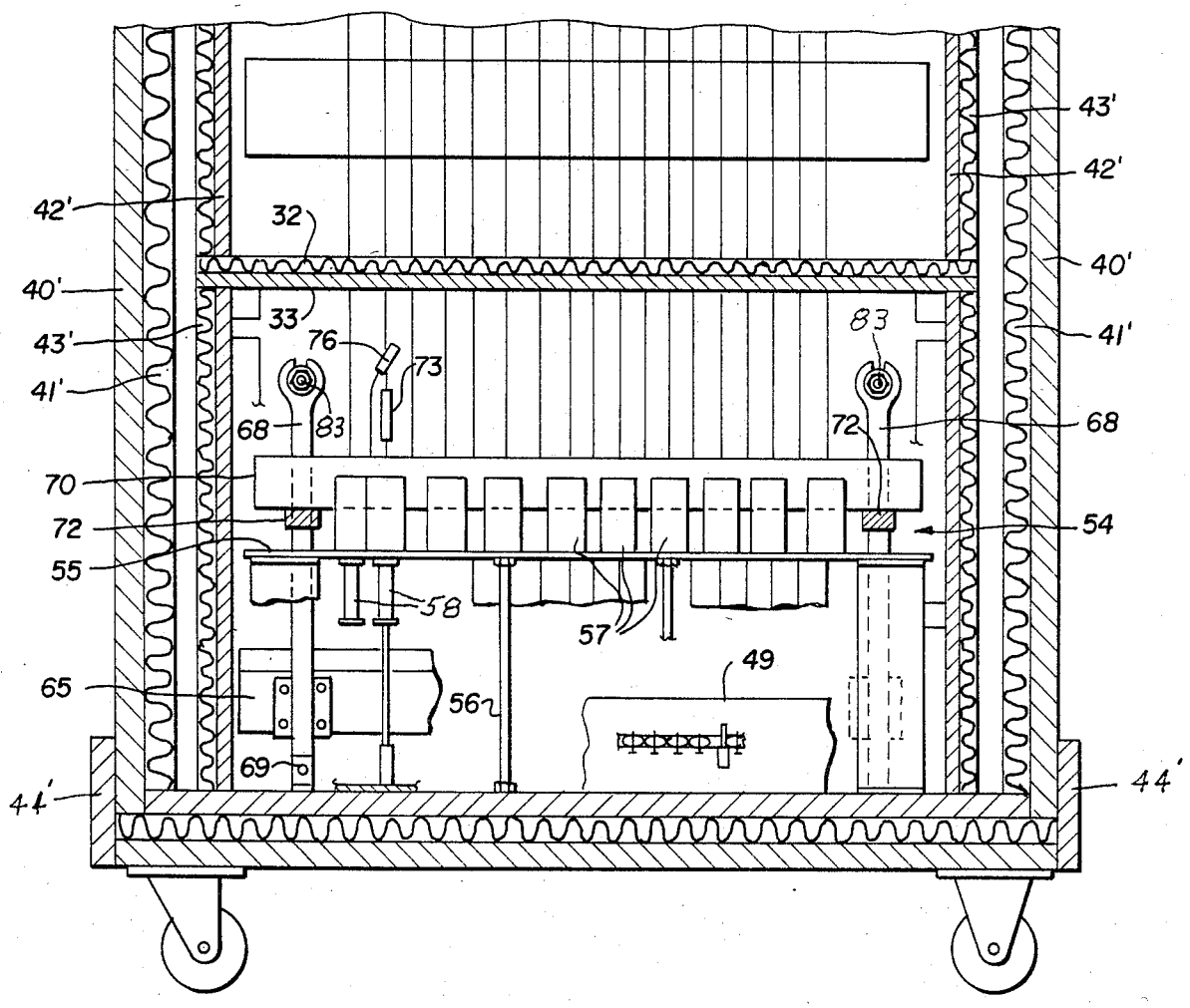
FIG. 12 is a fragmentary front elevation of the lower portion of the machine, partly in cross section.

The soundboard or enclosure 22 further comprises exterior side walls 40', FIG. 3, having acoustical insulation 41' attached to their interior faces. Interior side walls 42' spaced from the exterior side walls have acoustical insulation 43' on their outer faces, FIG. 12. Side skirts 44' complete the closing of the soundboard at the lower corners on its opposite sides. Vertical cover strips 45' are similarly provided at the rear vertical corners of the soundboard.

In essence, therefore, it should be apparent that the soundboard 22 of the machine is a double enclosure in which the spaced interior and exterior walls are acoustically insulated over substantially their entire areas. The rear vertical wall of the soundboard adjacent to the strings 47 is doubly insulated between the block 39 and a rear vertical panel 42. An acoustical insulation layer 41 covers the rear face of the block 39 from a point near its bottom to an elevation somewhat below the tuning pins 48. A thicker acoustical insulation layer 43 covers the forward face of back vertical panel 42, as shown in FIG. 4. The panel 42 is secured by screws 44 to the block 39 in spaced parallel relationship thereto. A lower horizontal skirt strip 45 completes the closing of the soundboard 22 at its lower rear corner below the back panel 42. A front interior vertical panel 46 extends between the forward edge of horizontal interior cover 33 and the bottom interior panel 27.

The standard electric bass guitar strings 47 are held in a substantially vertical plane forwardly of the standard piano double pin block 39. The upper ends of the strings 47 are attached to piano tuning pins 48, held in the block 39 near and below its top edge. The lower ends of the guitar strings engage a standard bass guitar bridge 49 anchored to the forward face of the block 39 near its bottom. The lower ends of the strings 47 are conventionally anchored as indicated at 50 in FIG. 4.

Somewhat below the tuning pins 48, the guitar strings 47 engage bass guitar nuts 51 at various elevations.

Pressure bars 52 forwardly of the block 39 are attached thereto by screws 53, as shown in FIG. 4.

Within the lower forward chamber 54 of the soundboard 22 and forwardly of the guitar strings 47 is mounted a horizontal solenoid shelf 55, supported adjustably on screw-threaded shelf support rods 56. Electrical solenoids 54 are mounted in two parallel transverse rows on the shelf 55, FIG. 3. Each solenoid 57 has a vertical axis plunger 58 connected with a horizontal drive link 59, FIG. 5, adjustably connected with a vertical screw-threaded rod 60, and being guided by a vertical guide rod 59' extending downwardly from the shelf 55. The lower end of each rod 60 is threadedly connected to an ell 61 forming a well-known part of a conventional upright piano action. The upright piano action may be substantially of the type shown in U.S. Pat. No. 356,109 issued to Ellis and in other patents.

Figure 5:
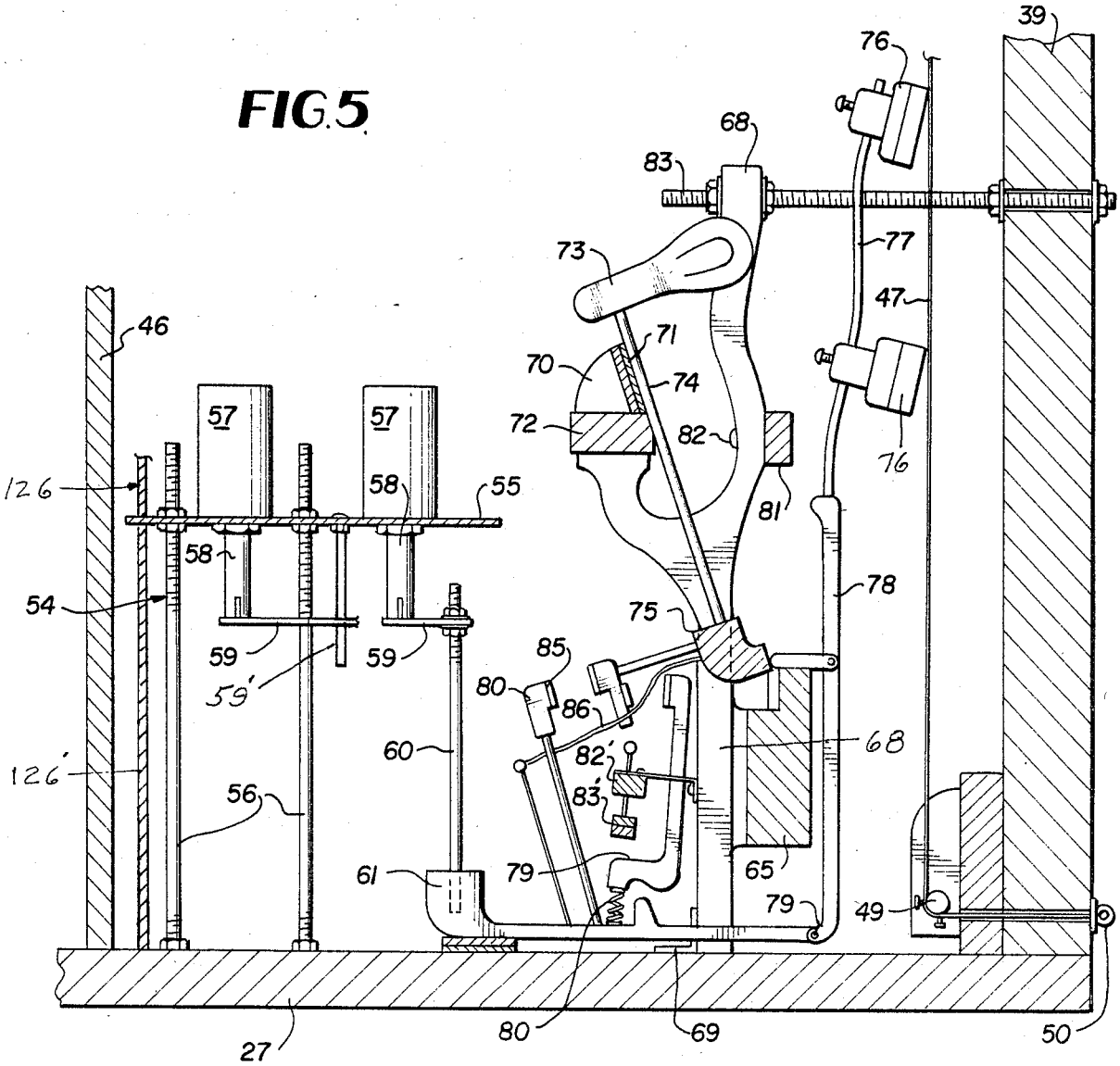
FIG. 5 is an enlarged fragmentary vertical cross section of the hammer mechanism and associated elements, parts omitted.

Briefly, the piano action comprises a transverse standard vertical action rail 65, FIG. 5, near and above the interior bottom panel 27 and somewhat forwardly of the bridge 49. The rail 65 is supported on a pair of transversely spaced action brackets 68 whose lower ends are attached to the interior bottom panel 27 by L-brackets 69. A hammer rail 70 having an inclined felt pad 71 on its forward face is attached to supports 72 secured to the action brackets 68.

The standard upright piano action includes hammer heads 73 carried by hammer shanks 74 rising from a hammer butt 75. A set of damper heads 76 for each string and hammer is held adjustably on a damper rod 77 secured to an upright jack 78 pivotally attached at 79 to the ell 61. The usual backcheck means 80 and pad 85 is provided, along with a strap 86. A hammer spring rail 81 is secured to the rear of action brackets 68 by screws 82, FIG. 5. In this figure, the numeral 82' denotes the let-off rail and the numeral 83' denotes the let-off button. The tops of action brackets 68 are stabilized by horizontal threaded rods 83 which extend rearwardly and are adjustably connected with the block 39, as shown in FIG. 5. Other components of the piano action are well known in their construction and operation and the hammer action need not be further described for a full understanding of the invention. Suffice it to say that each solenoid 57 controls the operation of one hammer 73 and two dampering heads 76 for each bass guitar string 47, and the solenoids, string striking hammers and dampering head pairs correspond in number to the strings 47.

Figure 8:
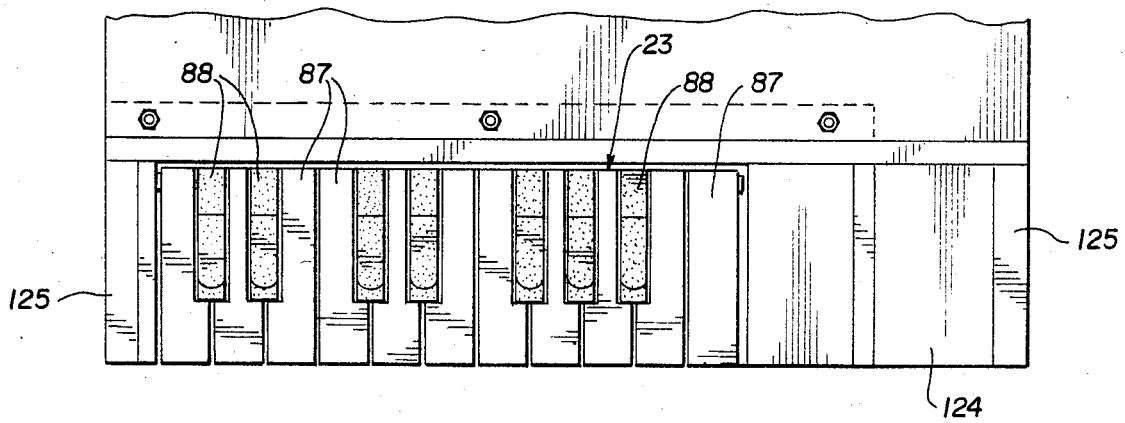
FIG. 8 is a plan view of a keyboard.
Figure 9:
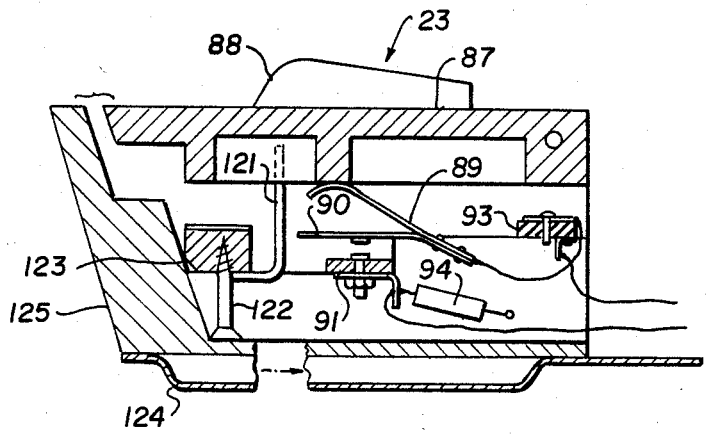
FIG. 9 is a vertical section taken through the keyboard.

The solenoids 57 are remotely controlled by the musician who can operate the keyboard 23 or the pedalboard 24, or both, as need dictates, to provide the desired harmony. As shown in FIGS. 8 and 9, the keyboard 23 consists of the customary black and white keys 87 and 88, each having an upwardly biasing spring 89 associated therewith, which spring can engage an upper electrical switch contact 90 when a particular key of the keyboard is depressed by the musician. A lower switch contact 91 is engaged by the upper contact 90 when the latter is depressed, closing an electrical circuit for each key and delivering 24 volts DC through a 20-foot power cable 92, FIG. 11, having conductors leading to the coils of the solenoids 57.

Figure 11:
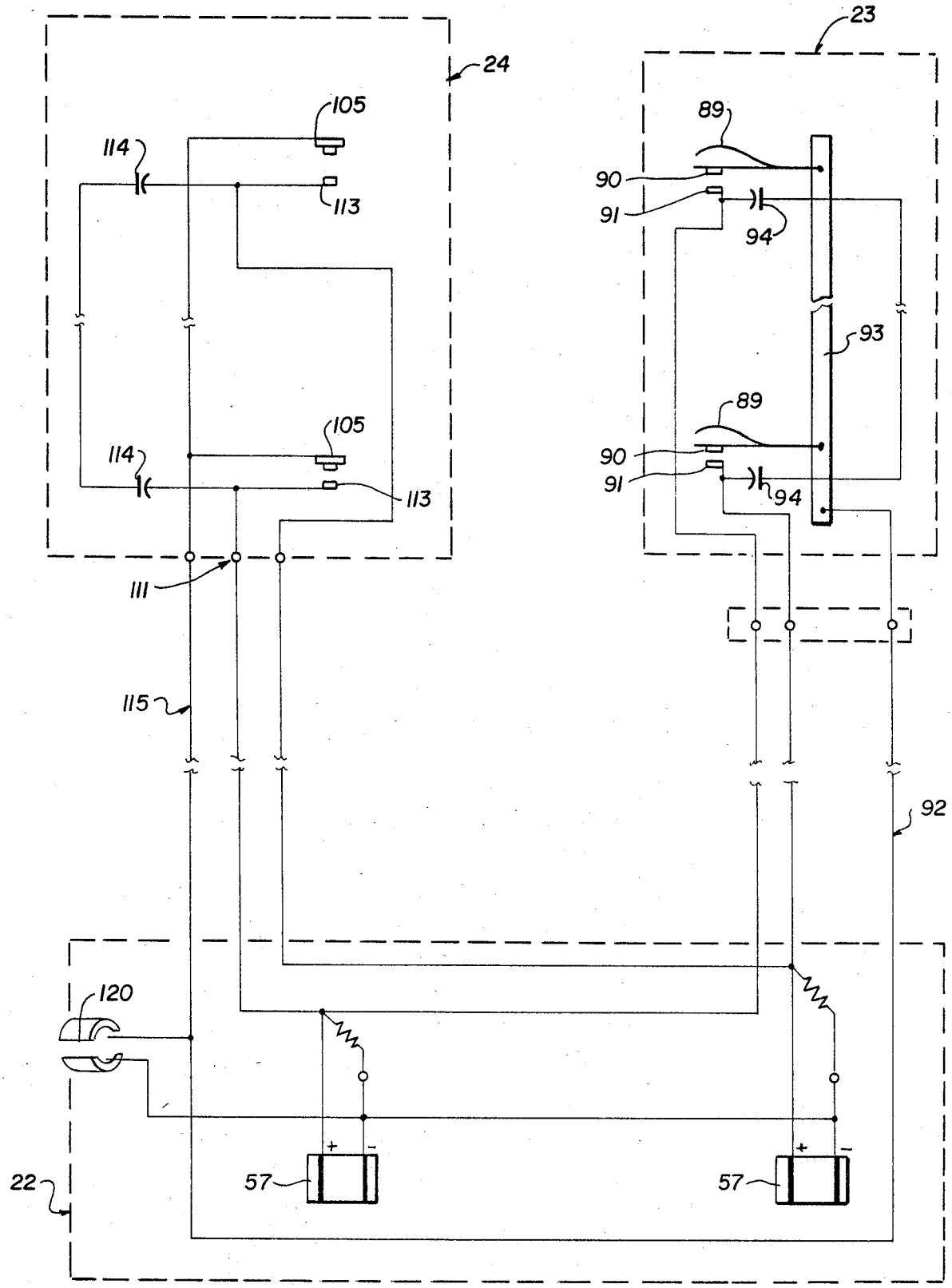
FIG. 11 is a schematic view of circuitry for the pedalboard and keyboard.

The spring 89 for each keyboard key is attached to a common fixed spring mounting strip 93. Each lower switch contact 91, FIG. 11, is serially connected to a capacitor 94 in each keyactivated circuit of the cable 92.

Figure 6:
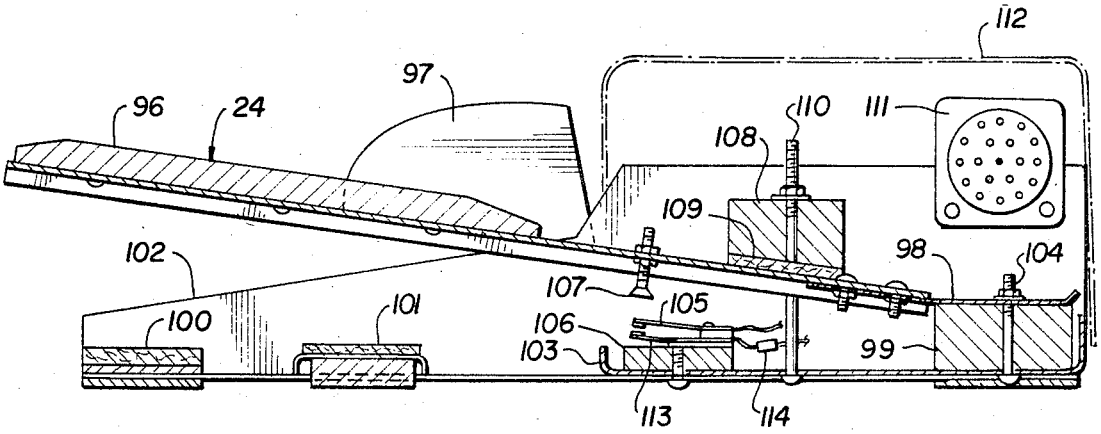
FIG. 6 is a vertical cross section taken through the pedalboard.
Figure 7:
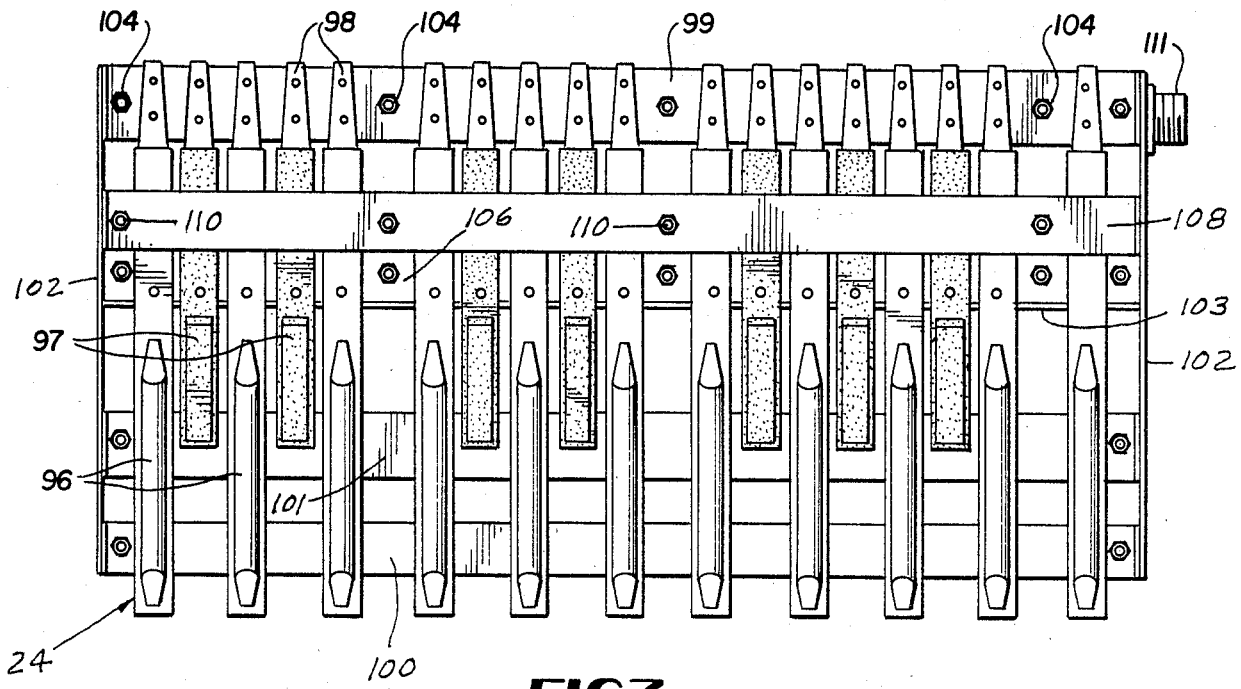
FIG. 7 is a plan view of the pedalboard.

Similarly, the pedalboard 24, FIGS. 6 and 7, comprises long and short pedals 96 and 97, each being supported on a leaf spring 98 secured to a pedal mount 99. Felt stops 100 and 101 for the long and short pedals 96 and 97 are mounted below the pedals on side plates 102 connected with a pedalboard pan 103 secured to the pedal mount 99 by bolt means 104.

Each long and short pedal operates a dual contact switch 105 held on a switchboard 106, each such switch being closed by an adjustable screw actuator 107 of each long and short pedal. Upward movement of each pedal is arrested by contact with a pedal tension board 108 having a bottom felt facing 109. The tension board 108 is connected by a bolt 110 with the underlying pan 103, FIG. 6. The pedalboard 24 includes at one end a 19 point receptacle 111 mounted on one of the side plates 102. The pedalboard has a removable cover 112, FIG. 6.

A lower contact 113 of each pedal switch 105 is connected with a capacitor 114. The switches 105 for the long and short pedals 96 and 97, FIG. 11, are connected in parallel, as are the keyboard switches. The pedalboard switches have their conductors included in a preferably 20-foot cable 115 leading through one side wall of the soundboard 22, FIG. 3. The keyboard cable 92 enters the soundboard or enclosure 22 at the same point.

The external control box 20, FIG. 10, receives 120 volts AC from a power cable 116 through an adapter 117 on the control box. The on-off switch 21 for the machine is connected between the 120 volt AC power supply and the primary of a stepdown transformer 118 having a 24 volt AC output through its secondary. A conventional rectifier circuit 119 in the control box 20 connected with the secondary coil of transformer 118 delivers 24 volts DC through a 15 foot power cable 120 to the soundboard 22 and its solenoids 57, as shown in FIGS. 3 and 11. The 24 volt DC power delivered by the cable 120 is selectively activated through each of the solenoids 57 by the described keyboard and/or pedalboard switches. As previously stated, the musician can operate the keyboard 23 or pedalboard 24 separately or can operate them simultaneously. He can also operate one or more keys or pedals and their associated electrical switches simultaneously to create certain desired harmonious tones which the machine is capable of producing.

Further, with respect to the keyboard 23, FIG. 9, each key 87 and 88 carries an upward motion stop element 121 which engages the bottom of the key bumper 123. The key bumper is anchored and supported by a screw 122, as shown. The keyboard also includes a pan 124 connected to sides 125.

It should further be noted that the solenoids 57 on the shelf 55 are enclosed within an acoustically insulated rectangular enclosure 126 which suppresses sound generated by the solenoids during the operation of the machine. As shown in FIGS. 4 and 5, a third vertical panel 126' encloses the area beneath the solenoid shelf 55.

Operation

In the operation of the electro-mechanical stringed bass machine, in the 24 volt DC power cable 120, the ground lead wire is commonly connected with a negative terminal of each solenoid 57. The positive lead wire of cable 120 is connected to dual lead wires of the cables 92 and 115 for the keyboard 23 and pedalboard 24, respectively. Should current flow require adjustment, an adjustment means 127, FIG. 10, is provided in the control box 20.

At the keyboard 23 and pedalboard 24, current flows through the contacts of the individual key and pedal switches 90–91 and 105 when the various keys and pedals are depressed by the musician. The current then returns to the positive terminals of the corresponding solenoids 57 which directly control the piano action including the hammer heads 73 which strike the guitar strings 47 to produce musical sounds and the dampering heads 76.

The musician, by operating the remote keyboard 23 and/or pedalboard 24 is able to produce a unique sound of tonal quality and effect by a method not known to exist in any other instrument.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A stringed bass machine comprising an acoustically insulated enclosure having an upright portion and a forwardly projecting lower portion, bass guitar strings held in a substantially vertical plane in the upright portion of said enclosure, an upright piano action within said lower portion of the enclosure forwardly of said strings, an electro-mechanical operating means for the piano action within the lower portion of the enclosure forwardly of the piano action and being operatively connected therewith, a remote electrical control unit external to said enclosure and being electrically connected to said electro-mechanical operating means, remote independently operable keyboard and pedalboard units each being adapted for connection with said electro-mechanical operating means, and the keyboard and pedalboard units each having switches one for each key and pedal of the units, whereby a musician operating the machine may utilize the remote keyboard and pedalboard units separately or simultaneously.

2. An electro-mechanical stringed bass machine comprising a soundboard, bass guitar strings held on the soundboard in a common plane, electro-mechanical means including hammers to strike the strings and dampering heads to engage the strings, an electrical power source to power the electro-mechanical means including a control box separate from the soundboard, remote separate and independently operated key and pedalboards including key and pedal switches which are electrically connected with the electro-mechanical means to operate the same, said soundboard comprising an acoustically insulated enclosure for said bass guitar strings and said electro-mechanical means, the acoustically insulated enclosure comprising substantially a spaced double walled enclosure in which each wall thereof is acoustically insulated at least in part, said acoustically insulated enclosure having a rear upright portion and a forward reduced height portion extending forwardly from the bottom of the upright portion, an upright block within the upright portion of the acoustically insulated enclosure, said guitar strings being held on said block in a substantially vertical plane, and said electro-mechanical means being disposed substantially in said forward reduced height portion of said enclosure and forwardly of said strings.

3. An electro-mechanical stringed bass machine as defined in claim 2, and said electro-mechanical means including an upright piano action including said hammers and dampering heads.

4. An electro-mechanical stringed bass machine as defined in claim 2, and tuning pins for said strings on said block near the top thereof, and a bridge means for said strings fixed near the bottom of said block.

5. An electro-mechanical stringed bass machine as defined in claim 4, and the electro-mechanical means further comprising electrical solenoids one for each hammer of the piano action within said forward reduced height portion of said enclosure, and an acoustically insulated sub-enclosure for said solenoids within the forward reduced height portion of the acoustically insulated enclosure.

6. A stringed bass machine comprising an acoustically insulated enclosure having an upright portion and a forwardly projecting lower portion, bass guitar strings held in a substantially vertical plane in the upright portion of said enclosure, an upright piano action within said lower portion of the enclosure forwardly of said strings, an electro-mechanical operating means for the piano action within said lower portion and forwardly of the piano action. an electrical control box separate from and external to said enclosure and having a machine on-off switch, an input AC power cable, an output reduced voltage DC power cable and transformer and rectifier means connected between said power cables, the output DC power cable being adapted for connection with said electro-mechanical operating means in said enclosure, remote independently operable keyboard and pedalboard units each having a cable extending therefrom and adapted for connection with said electro-mechanical operating means in said enclosure, and the keyboard and pedalboard units each having switches one for each key and pedal of the units electrically connected in said cables of the units, whereby a musician operating the machine may utilize the remote keyboard and pedalboard units separately or simultaneously.

7. A stringed bass machine as defined in claim 6, and the electro-mechanical operating means comprising a plurality of electrical solenoids, one for each switch of the keyboard and pedalboard units and being operably connected with the latter.

8. A stringed bass machine as defined in claim 7, and an acoustically insulated enclosure for said solenoids within and separate from the first-named enclosure.

9. A stringed bass machine as defined in claim 7, and a horizontal shelf supporting said solenoids at an elevated position within said lower portion of the acoustically insulated enclosure.

10. A stringed bass machine as defined in claim 9, and drive linkage means connected between the plungers of said solenoids and elements of said piano action.

* * * * *